United States Patent [19]

Kennon et al.

[11] 4,338,364

[45] Jul. 6, 1982

[54] CONTINUOUS COATER

[75] Inventors: James L. Kennon, Avon; Lawrence J. Macartney, Lorain; Gerald W. Crum, Elyria; John C. Dunn, Amherst; Donald R. Hastings, Elyria, all of Ohio

[73] Assignee: Nordson Corporation, Amherst, Ohio

[21] Appl. No.: 237,525

[22] Filed: Feb. 23, 1981

Related U.S. Application Data

[63] Continuation of Ser. No. 111,666, Jan. 14, 1980, abandoned.

[51] Int. Cl.[3] ..... B05D 1/02

[52] U.S. Cl. ..... 427/424; 118/316; 118/323; 118/326; 118/DIG. 7; 427/421; 98/115 SB

[58] Field of Search ..... 118/316, 323, 326, 634, 118/DIG. 7; 427/421, 345, 424; 98/115 SB

[56] References Cited

U.S. PATENT DOCUMENTS

| | | | |
|---|---|---|---|
| 2,097,953 | 11/1937 | Ludwig | 98/115 SB |
| 3,138,087 | 6/1964 | Larsson et al. | 98/115 SB |
| 3,516,388 | 6/1970 | Barnes | 427/424 |
| 3,750,622 | 8/1973 | Repp et al. | 118/326 |
| 3,906,895 | 9/1975 | Morino et al. | 118/326 |
| 4,129,092 | 12/1978 | Wiggins | 118/323 |

*Primary Examiner*—Shrive P. Beck

*Attorney, Agent, or Firm*—Wood, Herron & Evans

[57] ABSTRACT

A continuous coater of the type having a conveyor extending through a coating booth where paint or other material is sprayed onto the products as they are conveyed through the booth. The booth has an air flow control vestibule located adjacent the entrance and exit ports. Each vestibule is connected to an air flow exhaust system and is so configured that it is operative to draw air almost exclusively from outside the booth into the exhaust system so that there is a minimum of input air to the exhaust system from within the booth. The incoming air from outside the booth effectively forms a flow barrier to the egress of sprayed material and/or solvent to the atmosphere through the vestibule entrance and exit ports. Preferably, there is located in each vestibule means for creating an air curtain which functions to minimize the egress of paint or solvent from the coater cabinet and to provide a more nearly saturated atmosphere inside the cabinet.

23 Claims, 8 Drawing Figures

CONTINUOUS COATER

This is a continuation of application Ser. No. 111,666, filed Jan. 14, 1980, now abandoned.

This invention relates to a coater and more particularly to a so-called continuous coater. Continuous coaters generally comprise a cabinet through which a product is conveyed, and within which a coating of paint or other material is sprayed from nozzles positioned interiorly of the cabinet. That sprayed material which is not deposited on the product is generally recovered and recycled.

One of the most common problems encountered with all continous coaters is that of containing the material overspray and solvents within the spray cabinet so that they do not escape to the atmosphere through the product entrance and exit ports. Those ports are never closed during the spray cycle so that it is difficult to prevent airborne sprayed material and/or solvents from escaping through these ports. The problem is compounded by the fact that the moving products create air currents which tend to convey any airborne over-spray or solvents out of the cabinet.

In the past, continuous spray booths have existed in the prior art which attempted to solve this problem by withdrawing air from the interior of the booth through an exhaust system wherein filters or other devices extracted the over-sprayed material from the air before it was exhausted to atmosphere. This type of booth air extraction system inherently creates other problems while solving the problem of over-sprayed materials or solvents escaping to the atmosphere. Specifically, it commonly reduces the efficiency of the system in that it detracts from the percentage of sprayed material applied to the product. Additionally, in the case of solvent base paints or sprays, it causes substantial quantities of vaporized solvent to be withdrawn from the booth and thereby renders it difficult to maintain a solvent saturated atmosphere within the booth. Such an atmosphere is desirable to prevent build-up of oversprayed material on the interior of the booth.

Another prior art approach to the problem of preventing the escape of oversprayed material from the entrance and exit ports of a continuous coater has been to place a vestibule around the entrance and exit ports of the coater and to connect those vestibules to an exhaust system within which a water spray is operative to remove air entrained sprayed material from the air. This particular prior art system relied upon the water flow within the exhaust system to create a relatively weak exhausting air flow from the vestibules. But, this system suffered from several deficiencies, primary among which was the fact that the ventilation flow from the vestibule was easily upset by ordinary external air drafts and turbulence which caused air entrained spray to billow forth from the coater cabinet into the atmosphere. Another deficiency of this prior art system was that it maintained a relatively continuous and substantial air flow from the booth into the exhaust system with the result that it was difficult to maintain a paint or solvent saturated atmosphere within the coater cabinet.

It has therefore been a primary objective of this invention to provide a continuous coater which overcomes all of the problems set forth hereinabove relative to prior art continuous coaters.

Specifically, it has been an objective of this invention to provide a coater which is more efficient in coating utilization than has heretofore been the practice.

Another objective of this invention has been to provide a coater booth which is effective to prevent the escape of sprayed material from the entrance and exit ports of the booth under all operating conditions of the booth.

Still another objective of this invention has been to provide a continuous coater which not only minimizes the escape of oversprayed material to the atmosphere but additionally, minimizes the quantity of air extracted from the booth. By minimizing air extracted from the booth, it is possible to better control the atmosphere inside the booth and to maintain it saturated or nearly saturated with solvent preventing drying of oversprayed material and facilitating recovery and recycling.

The continuous coater which accomplishes these objectives comprises a continuous coater cabinet or booth having vestibules which extend outwardly from both the product entrance and exit ports. These vestibules are connected to an exhaust system including an exhaust fan which is operative to pull outside air into the vestibule in sufficient quantities and at a sufficient velocity to effectively form a barrier to the egress of oversprayed material through the vestibules. The construction of the vestibule is such that very nearly all of the air pulled into the vestibule to form the air flow barrier is air from outside the booth. Consequently, there is minimal air flow disturbance within the booth and therefore maximum sprayed material utilization.

In a preferred embodiment, there are air flow nozzles located within each vestibule which provide an air curtain flow of air directed toward the coater cabinet. This air flow minimizes the amount of airborne paint or sprayed material which escapes from the coater cabinet into the vestibules and enables the interior of the cabinet to be maintained saturated or very nearly saturated.

In addition to the advantages set forth hereinabove, this coater also has the advantage of being operable with lower total horsepower than prior art systems which relied upon water flow to generate the negative air pressure to prevent the egress of oversprayed material from the exit and entrance ports of the booth. Heretofore, whenever water flow was relied upon to induce exhaust air flow from adjacent the product exit and entrance ports, the system required very high horsepower to pump large quantities of water and still was unable to effect the appropriate air flow. The system of this invention which may include liquid scrubbing of the exhaust gases is much more efficient and has been proven to require less horsepower than required in water induced air flow systems of the prior art.

Another advantage of the system of this invention over the water induced air flow systems of the prior art is that it may be applied to much larger coaters than is practical in a water flow induced system.

Other objects and advantages of this invention will be more readily apparent from the following description of the drawings in which:

FIG. 3 is a diagrammatic top plan view of the system illustrated in FIG. 1.

Figures 1, 2:
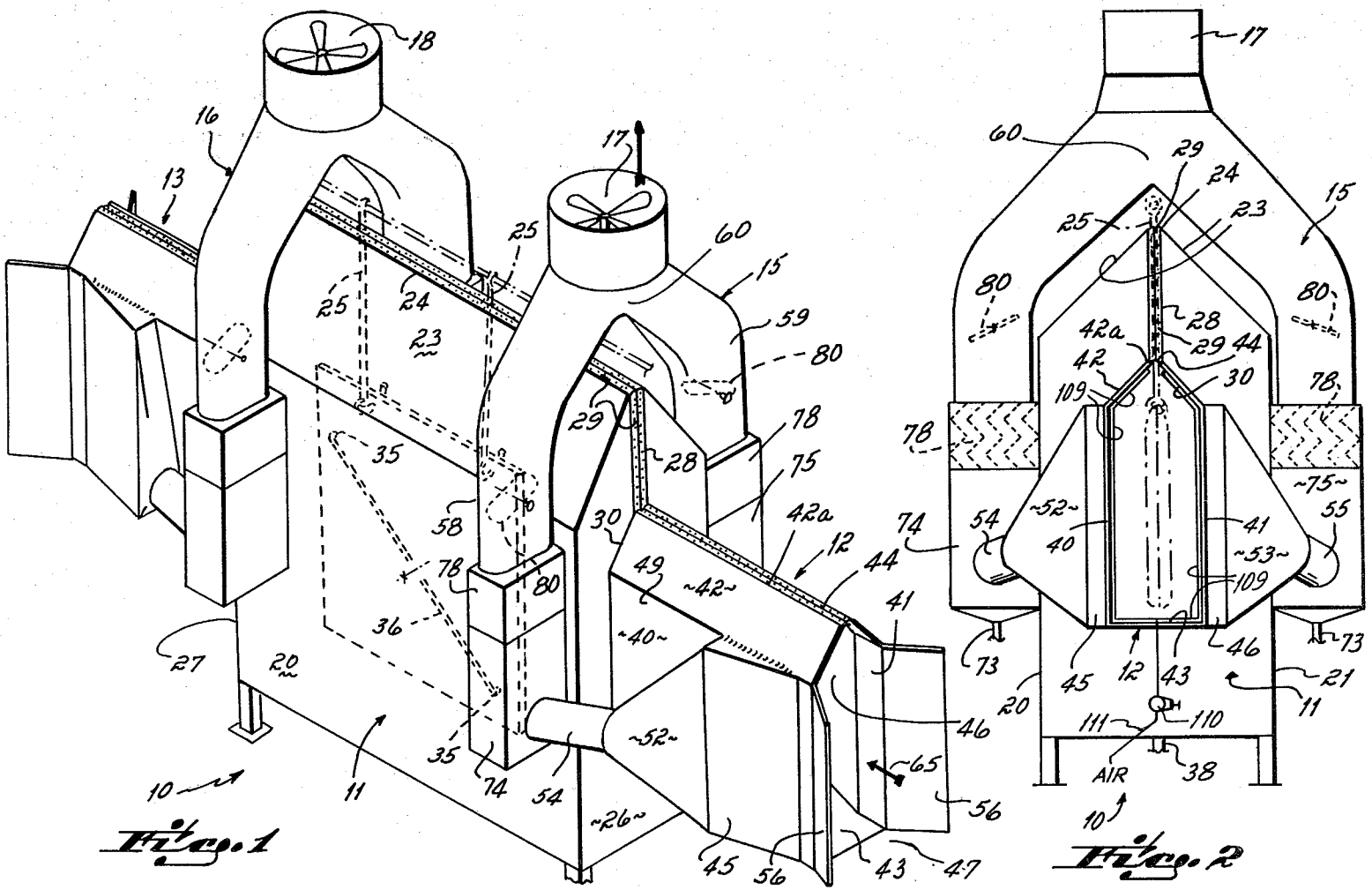
FIG. 1 is a perspective view of a continuous coater incorporating the invention of this application.
FIG. 2 is an end elevational view of the system illustrated in FIG. 1.

Referring to FIGS. 1–5, there is illustrated a preferred embodiment of continuous coater incorporating the invention of this application. This coater 10 comprises a coating booth or cabinet 11 having vestibules 12 and 13 extending from opposite ends through which product to be coated interiorly of the booth enters and exits from the booth. The vestibules 12, 13 are connected through duct systems 15, 16 to the atmosphere via suction fans 17, 18 respectively.

The coater booth 11 comprises a pair of side walls 20, 21, a downwardly sloping bottom wall 22, a ceiling 23 slotted at the top as indicated at 24 to permit the passage of conveyor suspension hooks 25 through the ceiling, and end walls 26, 27. The end walls are also slotted as indicated at 28 for the passage of the conveyor hooks through those walls. Additionally, the end walls 26, 27 have entrance 30 and exit 31 ports formed therein through which product suspended from the conveyor hooks 25 may pass into and out of the booth.

The slots 24 in the ceiling and the slots 28 in the end walls are closed by overlapping pliable strips 29 which close across the top and end wall slots of the coater cabinet so as to permit entry of the conveyor hooks 25 but limit overspray or air escape to or from the cabinet through the slots. In the embodiment illustrated in FIGS. 1–5, paint or other coating material is pumped from a reservoir (not shown) via a hydraulic pump (not shown) to rotating nozzles 35 mounted on the ends of rotating spray arms 36. Paint is pumped from the reservoir to these arms under high pressure and is forced through the nozzles as an atomized spray. Coating material which is not applied to the work falls to the bottom 22 of the coater booth where it is drained away through a siphon port 38 by a scavenger pump and returned to the main pump reservoir.

The coating booth heretofore described, including the conveyor system for transporting product through the booth, as well as the rotating nozzle and paint supply and return system are all conventional in the art and per se form no part of this application. Rather, the invention of this application resides in the booth in combination with the vestibules 12, 13 and duct systems 15, 16 for preventing the escape of air entrained sprayed material or solvent from the booth.

Vestibule

The two vestibules 12, 13 are identical. One vestibule 12 which is located adjacent the entrance port 30 of the booth will be described in detail. It will be understood that an identical vestibule 13 surrounds the exit port 31 and is attached to the opposite end 27 of the booth. The vestibule 12 functions as an enclosed passageway through which product may enter the spray cabinet 11. It has a pair of side walls 40, 41, a ceiling 42, and a floor or bottom wall 43. These walls 40, 41, 42 and 43 all are sealingly attached to the end wall 26 of the cabinet 11.

The ceiling 42 is longitudinally slotted as shown at **42*a* to facilitate the passage of the conveyor suspension hooks 25 through the vestibule. As in the case of the passage 24 in the spray cabinet, the slot 42*a* is closed by overlapping pliable strips 44 which extend across the slot. The pliable strips permit the entry of conveyor hooks but limit overspray or air from escaping through the slot to the atmosphere and additionally function to prevent the ingress of air into the vestibule through the slot 42*a***.

A central section of each of the side walls 40, 41 of the vestibule taper outwardly from adjacent the outer end 47 of the vestibule so as to provide a rectangular air collector passage 48 on each side of the vestibule. These air collector passages 48 are defined by the outwardly flared sections of the side walls 45, 46, the unflared side wall sections 49, 50 as well as the ceiling 42 and bottom walls 43 of the vestibules. Each of these rectangular collector slots 48 is connected by a funnel-shaped section of conduit 52, 53 to a circular duct 54, 55 respectively. The funnel-shaped sections of ducts 52, 53 are rectangular at the input end which is connected to the air collector slot 48 and are circular at their output end at which point they are connected to the circular ducts 54, 55.

Figure 5:
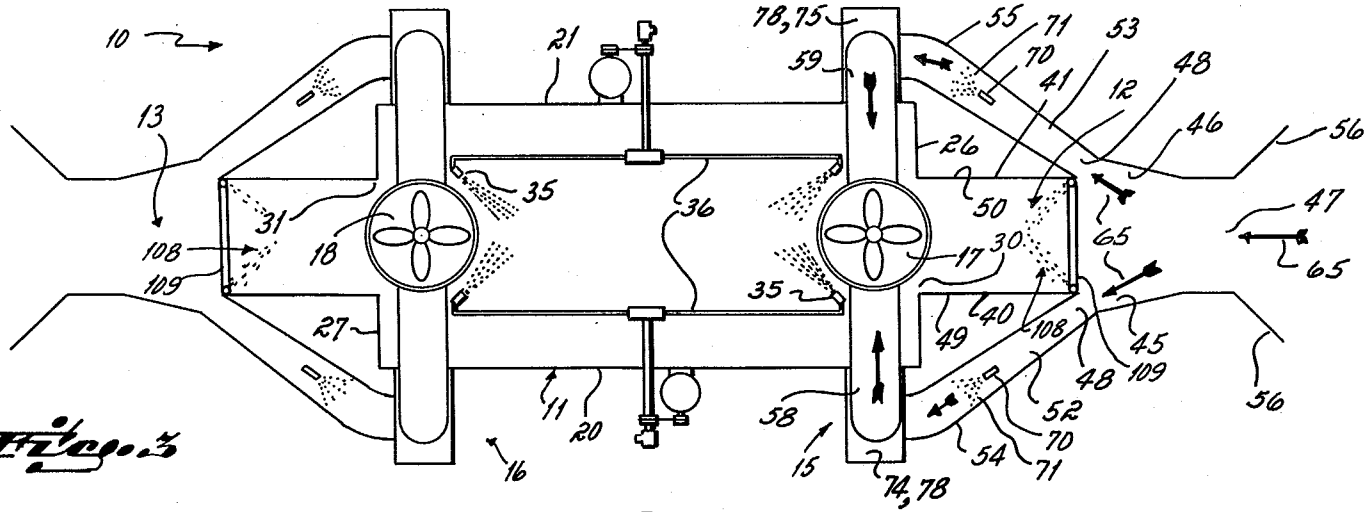
FIG. 5 is a perspective view, partially broken away, of the vestibule portion of the coater illustrated in FIG. 1.

Referring to FIGS. 2, 3 and 5 it will be seen that there is combined within each vestibule, means for creating an air curtain 108. This air curtain 108 is created by pressurized air discharged from conduits 109 through holes or slots 112 aligned so as to form a flow of air in the vestibule at a location between the air collector slots 48 and the vestibule/coater cabinet 11 interface. These conduits 109 conform to the cross-sectional silhouette of the vestibule opening. The slots 112 in the conduits 109 are operative to create an air flow curtain 108 directed at a selected angle inwardly toward the paint spray cabinet. Flow of air within the air curtains 108 may be adjusted and varied by air pressure regulators 110 located in the air line 111 which supplies the conduits 109. By properly adjusting the regulators 110, and balancing the air pressure at each vestibule/coater cabinet 11, it is possible to slightly pressurize the coater cabinet 11 thereby minimizing the amount of airborne paint and solvent coming out of the coater cabinet 11 and being exhausted into the collector slots 48 and maintaining a more nearly saturated atmosphere inside the coater cabinet 11.

At the outer ends, the vestibule's side walls 40, 41 preferably have an outwardly extending flange 56 which forms an extension of the side wall. These flanges extend at an angle of approximately 45° to the vertical plane of the side walls and serve as wind or draft deflectors at the outer opening of the vestibules.

Figure 4:
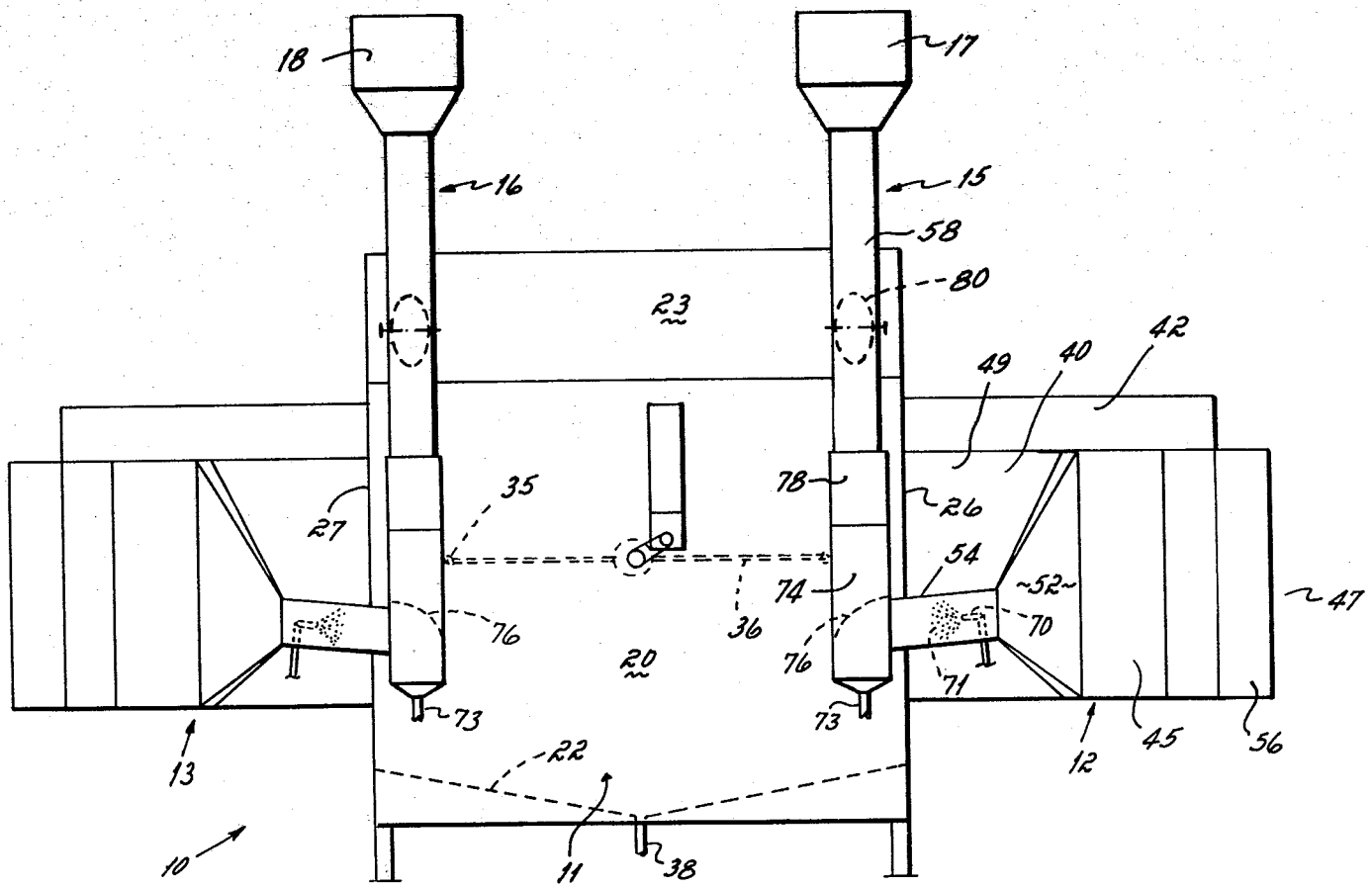
FIG. 4 is a side elevational view of the system illustrated in FIG. 1.
Figure 5:
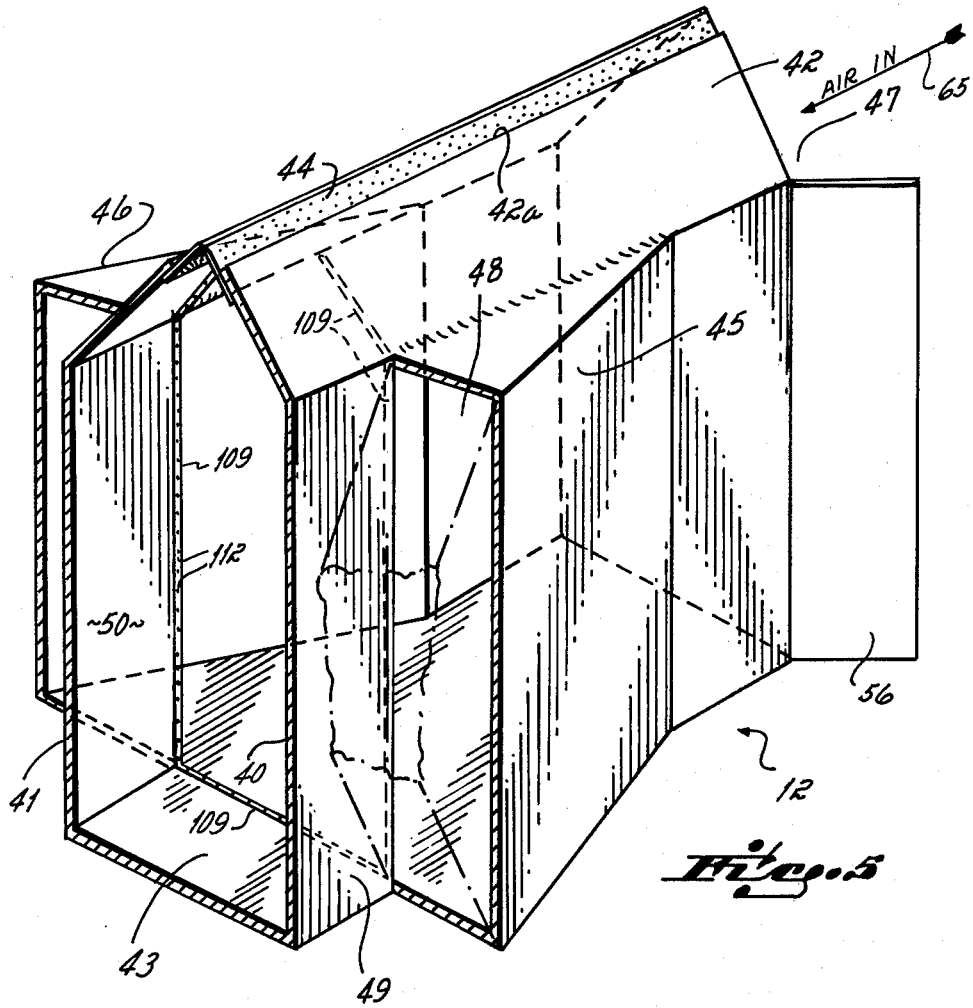

As may be seen most clearly in FIGS. 1, 2 and 4, the ducts 54, 55 extend in a generally horizontal direction but slope slightly downwardly. At the inner ends each duct 54, 55 is connected to a vertical section of expansion chambers 74, 75 respectively which extends up the sides of spray cabinet 11 to baffle boxes 78 and through ducts 58, 59 respectively. At the upper end each vertical section of duct 58, 59 is joined as illustrated at 60 and connected to the exhaust fan 17. When the fan 17 is operating it is operative to pull air through the outer end 47 of the vestibule as indicated by arrow 65 through the air collector slots 48 into the duct systems via the conduit 54, expansion chamber 74, baffle box 78, conduit 58, conduit 55, expansion chamber 75, baffle box 78, and conduit 59. As is explained more fully hereinafter, this air movement forms a flow barrier at the outer end of the vestibule to the escape of oversprayed paint or solvents from the spray cabinet 11.

The coater illustrated in FIGS. 1–5 may be used for spraying either dry powder materials or wet liquid paints or materials onto products passing through the cabinet 11. The coater illustrated in FIGS. 1–5 is primarily intended to be used for the application of wet paints or liquid sprayed material and for that reason is equipped with a liquid scrubbing system for extracting any airborne paints or sprayed material from the exhaust air before it is exhausted to atmosphere. To that end there is included in each of the ducts 54, 55 a liquid spray nozzle 70 through which liquid is sprayed to create a liquid scrubber 71 within each of the ducts 54, 55. These liquid scrubbers 71 are effective to catch any air entrained particles and cause those particles to run out of the duct system through a liquid outlet 73 to a separation tank (not shown).

The expansion chambers 74, 75 are sized so as to be of approximately twice the cross-sectional area as the ducts 54, 55.

Located within the expansion chamber 74, 75 there is a downwardly curved deflector 76. This deflector is slightly wider than the diameter of the entering duct 54, 55 but narrow enough to allow a cross-sectional area past the deflector at least equal to the area of the entering duct. The downwardly curved deflector in combination with the expansion chamber functions to cause some of the heavier particles entrained in the air stream entering from the ducts 54, 55 to drop out of the entrained air and to flow via the drain pipes 73 to the separation tank.

Located above the arcuate deflector 76 in each of the expansion chambers 74, 75 are baffles 78. These baffles function as final stage filters to prevent any liquid air entrained solid particles from escaping through the duct systems 15 and 16 to the atmosphere.

At its upper end each vertical duct 58, 59 contains a manually adjustable butterfly valve 80 for controlling the relative quantity of air pulled through each of the ducts 58, 59. Thus, it is possible by manually rotating the valves 80 to adjust the air flow through each of the ducts 58, 59 so as to bring the air flow through each of the ducts 58, 59 into balance, thereby insuring that there is a uniform flow of air through each of the collector slots 48 located on the opposite side of the vestibule 12.

In operation, paint is supplied at a relatively high pressure to the nozzles 35 of the rotating arms 36 via a pumping system (not shown). The paint is ejected through the spray nozzles 35 onto product as the product is conveyed through the cabinet. Excess paint is collected from the bottom of the booth via the siphon 38 and is returned to the paint reservoir (not shown). Simultaneously, the suction fans 17 and 18 are operated so as to cause air to be pulled from outside the openings 47 of the vestibules into the vestibule collector slots 48. The butterfly valves 80 in each of the vertical legs 58, 59 of the duct system are adjusted so that a relatively even and balanced air flow is maintained through each of the slots 48. The applicants have found that a minimum air flow velocity of approximately 800 feet per minute should be maintained through each of the slots, and that the optimal velocity is on the order of a thousand feet per minute. By maintaining a balanced flow of air through the opposed slots 48 of each vestibule, an even flow of air is maintained over the full cross section area of the vestibule openings 47. This even flow of air across the full cross section of the vestibule functions as an effective air flow barrier to the escape of any airborne spray through the entrance and exit ports of the vestibule. Since that air flow barrier extends over the full area in the vertical plane of the vestibule openings the egress of any airborne particles to the outside atmosphere is effectively prevented.

The cabinet 11 is substantially sealed against the inflow of air. The construction of the vestibule and collector slots 48 is such that very nearly all of the air pulled into the vestibule to form the air flow barrier is from outside the booth. Consequently, there is a minimum air flow from the interior of the cabinet into the vestibule. Any airborne paint particles or solvent though contained within the air and entering the vestibule through the air curtain 108 is caused to flow by the air stream into the air collector slots 48. Those airborne particles then are removed from the air stream by the liquid scrubber 71 located within the ducts 54, 55. That liquid then flows from the duct system via the drain pipe 73 to a liquid separation tank. The exhaust air flows upwardly through the duct system and out through the exhaust fans 17, 18.

The very minimal flow of air from the paint cabinet 11 out through the exhaust system enables the atmosphere within the cabinet 11 to be very closely controlled. The atmosphere within the cabinet can be maintained very nearly solvent saturated and thereby the build-up of paint on the interior walls of the cabinet can be avoided.

Figure 6:
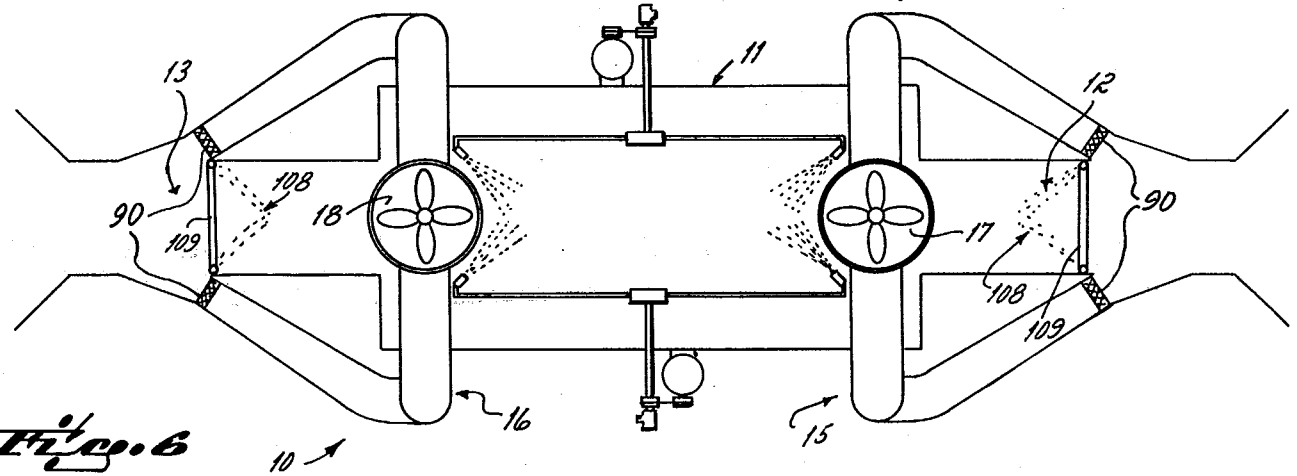
FIG. 6 is a diagrammatic top plan view of a second embodiment of continuous coater incorporating the invention of this application.

The coater described hereinabove and illustrated in FIGS. 1–5 is primarily intended for use in the application of a wet paint or spray material to products passing through the coater. The system though is equally applicable to the application of a dry paint or sprayed material in the form of a powder. Such a system as illustrated in FIG. 6 is equally applicable to dry powder or wet spray operation. In general, this coater is identical to the system illustrated in FIGS. 1–5 except that it has no liquid cleansing system for extracting the airborne particles from the exhaust system. In other words, the liquid spray nozzles are omitted from the system as is the liquid drain pipe 73. Instead, dry collection filters 90 are placed in the exhaust slots so as to collect any sprayed material which would otherwise be drawn into the exhaust system. In all other respects this system is identical to that described in FIGS. 1–5 and operates in exactly the same way to prevent the exhausting of airborne sprayed materials to the atmosphere.

Figure 7:
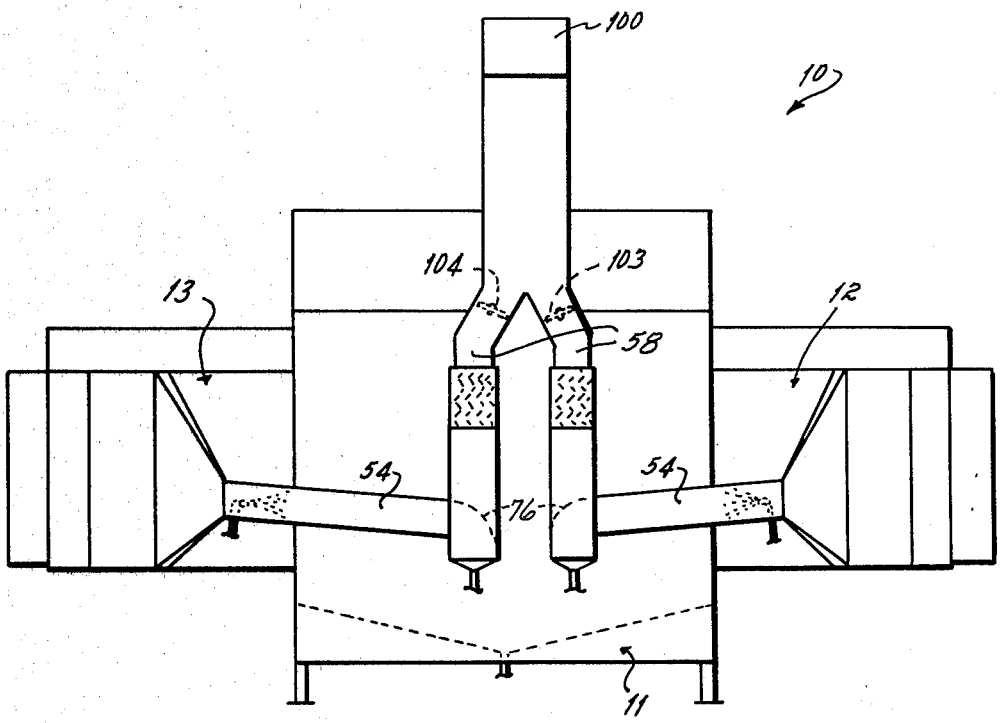
FIG. 7 is a side elevational view of a third embodiment of the continuous coater incorporating the invention of this application.
Figure 8:
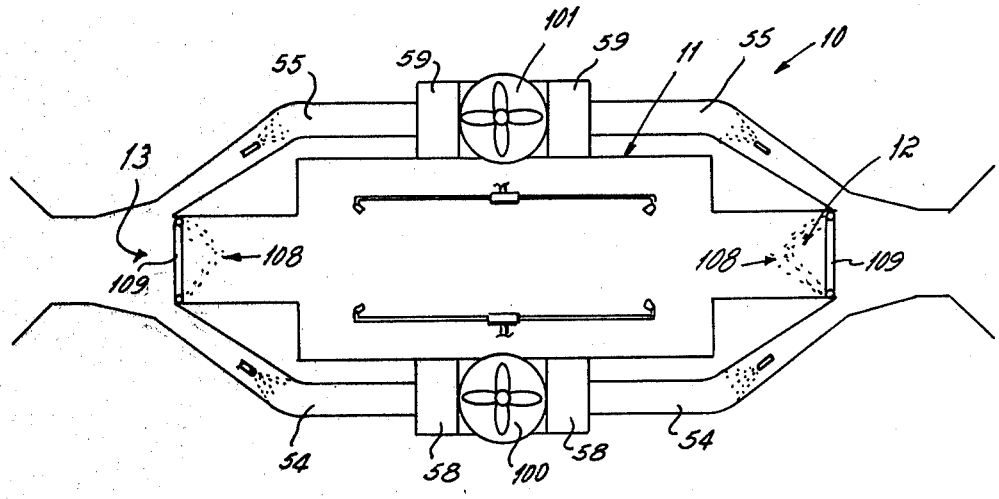
FIG. 8 is a top plan view of the continuous coater illustrated in FIG. 7.

Referring now to FIGS. 7 and 8, there is illustrated still a third embodiment of the invention. This embodiment again is primarily intended for use in the coating of liquid paints or spray material onto products passing through the coater. Those components of this embodiment which are identical to components of the embodiment of FIGS. 1–5 have been given identical numeral designations.

In the embodiment illustrated in FIGS. 7 and 8, the spray cabinet 11, the vestibules 12 and 13, and the system for supplying paint to the booth and for draining paint away from the booth are identical to the corresponding components of the embodiment illustrated in FIGS. 1–5. Similarly, the system for preventing the escape of air entrained sprayed particles and/or solvent to the atmosphere is identical through the vestibule exhaust ducts 54, 55 and expansion chambers 74, 75. Above the baffles 78 though the systems differ in that the two vertical ducts 58 on one side of the paint cabinet 11 are interconnected to a single exhaust fan 100 and the two vertical exhaust ducts 59 on the opposite side of the cabinet 11 are similarly interconnected to a common exhaust fan 101. As in the embodiments of FIGS. 1–5 though it is important that the air exhausted from the air collector slots 48 on opposite sides of a single vestibule be balanced from side-to-side so as to effectively maintain an air curtain barrier across the outer openings 47 of the vestibules 12, 13. To that end each vertical leg 58 of the duct system contains its own air balancing butterfly valve or damper 103, 104 and similarly each vertical duct 59, 59 on the opposite side of the cabinet contains its own air flow control butterfly valves (not shown). These air flow control butterfly valves 103, 104 are manually operated and adjusted so as to maintain the flows from the opposite sides of each vestibule balanced, even though those flows are controlled by different fans 100, 101.

Except for this different exhausting technique, i.e., the use of a single exhaust fan connected to the vertical ducts on the same side of the paint booth rather than a single fan connected to the exhaust ducts 58, 59 on the opposite sides of the paint cabinet as in the embodiment of FIGS. 1–5, the two systems are identical. Since each duct has its own balancing valve 103, 104, the operation of the system is identical after that air flow balancing is achieved.

In practice, the primary advantage of the continuous coater described in each of the three embodiments of this application resides in the fact that it maintains a very effective barrier to the egress of sprayed material from the booths through either the product entrance or exit ports. Specifically, the incoming air passing through the vestibule entrance and/or exit port 47 insures that neither the sprayed material nor solvents evolved from those sprayed materials escape from the coater to the atmosphere. Instead, those materials which might otherwise escape to the atmosphere are entrapped within the duct exhaust system and there removed from the air before the air is exhausted to the atmosphere.

While we have described only three embodiments of our invention, persons skilled in this art will appreciate numerous changes and modifications which may be made without departing from the spirit of our invention. As an example, we have described this invention as being applicable to both solvent and solvent-free spray materials but we do not intend by such description to limit the invention to any particular type of spray materials. Additionally, solvent type spray materials include water base paints and sprays in which the water acts as the solvent. Therefore, we do not intend to be limited except by the scope of the following claims:

We claim:

1. A coater comprising, a coating chamber adapted to have an object conveyed through it, said coating chamber having side walls, end walls, a bottom and a ceiling, entrance and exit openings in said end walls through which objects may be introduced into and out of said chamber, means for coating an object with a sprayed material in the course of passage through said chamber, air flow control vestibules extending outwardly from each end of said chamber adjacent said entrance and exit openings, each of said vestibules having an outer opening longitudinally aligned with but remote from the associated entrance and exit openings of said chamber, means for drawing air from outside said vestibules through said vestibules' outer openings without simultaneously drawing any substantial quantity of air from inside said chamber so as to create an air flow barrier to the escape from said chamber of airborne sprayed material, said last named means including at least one air collector slot located on opposite sides of each of said vestibules, exhaust fan means and duct means connected each of said air collector slots to said exhaust fan means whereby air is caused by said exhaust fan to flow into each of said vestibules through said outer openings and to be exhausted from said vestibules through said collector slots and said ducts.

2. The coater of claim 1 which further includes means for balancing the flow of air through the collector slots on the opposite sides of each of said vestibules.

3. The coater of claim 1, wherein said duct means contains a scrubber section wherein exhausted air is caused to pass through a liquid scrubber in the course of passage through said duct means.

4. The coater of claim 3, wherein said duct means includes a baffle section located between said liquid scrubber and said exhaust fan means.

5. The coater of claim 1 further including means located within each of said vestibules for creating an air curtain within said vestibules directed inwardly toward said coating chamber.

6. The coater of claim 5 wherein said air curtain creating means is operable to create said air curtain between said air collector slots and said coating chamber openings.

7. A coater comprising, a coating chamber adapted to have an object conveyed through it, said coating chamber having side walls, end walls, a bottom and a ceiling, entrance and exit openings in said end walls through which objects may be introduced into and out of said chamber, means for creating an area within the chamber wherein an object is coated with a sprayed material in the course of passage through the area, air flow control vestibules extending outwardly from each end of said chamber adjacent said entrance and exit openings, each of said vestibules having an outer opening longitudinally aligned with but remote from the associated entrance and exit openings of said chamber, each of said vestibules having inner and outer sections, said inner sections of each of said vestibules being of substantially constant cross sectional area, said outer section of each of said vestibules being of gradually increasing cross sectional area between said outer opening and said inner section, and a vestibule outlet opening located at the point at which said inner section is joined to said outer section, means for preventing air entrained sprayed material from escaping from the coating chamber into said air flow control vestibules and from said vestibules to the atmosphere, said escape preventing means including air flow means for creating an inwardly directed pattern of air flow from outside said vestibules through said vestibule openings over the complete cross sectional area of said outer openings of said vestibules, said air flow creation means including an exhaust fan for exhausting air from said vestibule outlet openings to the atmosphere.

8. The coater of claim 7 wherein said air flow creation means includes means for simultaneously exhausting air from opposite sides of each of said vestibules.

9. The coater of claim 7 wherein said vestibule exhausting means includes air collector slots located on opposite sides of each of said vestibules.

10. The coater of claim 7 further including means located within each of said vestibules for creating an air curtain within said vestibules directed inwardly toward said coating.

11. A coater comprising, a coating chamber adapted to have an object conveyed through it, said coating chamber having side walls, end walls, a bottom and a ceiling, entrance and exit openings in said end walls through which objects may be introduced into and out of said chamber, means for creating an area within the chamber wherein an object is coated with a sprayed material in the course of passage through the area, air flow control vestibules extending outwardly from each end of said chamber adjacent said entrance and exit openings, each of said vestibules having an outer opening longitudinally aligned with but remote from the associated entrance and exit openings of said chamber, means for drawing air from outside said vestibules through said vestibules' outer openings without simultaneously drawing any substantial quantity of air from inside said chambers so as to create an air flow barrier to the escape from said chamber of airborne sprayed material, said last named means including air flow means for creating an inwardly directed substantially uniform velocity of air flow from outside said vestibules through said vestibules' openings and across the full outer cross sectional areas of said openings of each of said vestibules.

12. The coater of claim 11 in which said air flow creation means includes air collector means located on opposite sides of each of said vestibules and connected to a suction fan for withdrawing air from said vestibules.

13. The coater of claim 12 in which each of said air collector means is connected to a suction fan through a duct system, said duct system including means for removing sprayed material from said air before said air is exhausted from said duct system to the atmosphere.

14. The coater of claim 13 in which said sprayed material removal means includes a baffle section.

15. The coater of claim 13 in which said sprayed material removal means includes a liquid scrubber.

16. The coater of claim 11 in which said air flow creation means includes air collector means located on opposite sides of each of said vestibules, each of said air collector means being connected to a suction fan through a duct system, and means within said duct system for adjusting the air flow through each of said air collector means.

17. The coater of claim 11 in which said air flow creation means includes air collector means located on opposite sides of each of said vestibules through which air is withdrawn from said vestibules, and means for balancing the air flow through the air collector means located on the opposite sides of each of said vestibules.

18. The coater of claim 11 further including means located within each of said vestibules for creating an air curtain within said vestibules directed inwardly toward said coating chamber.

19. A coater comprising, a coating chamber adapted to have an object conveyed through it, said coating chamber having side walls, end walls, a bottom and a ceiling, entrance and exit openings in said end walls through which objects may be introduced into and out of said chamber, means for creating an area within the chamber wherein an object is coated with a sprayed material in the course of passage through the area, at least one air flow control vestibule extending outwardly from one end of said chamber adjacent one of said entrance or exit openings, said vestibule having an outer opening longitudinally aligned with but remote from said one opening of said chamber, and means for drawing air from outside said vestibules through said vestibules'0 outer openings without simultaneously drawing any substantial quantity of air from inside said coating chamber so as to create an air flow barrier to the escape from said chamber of airborne sprayed material, said last named means being operable to create an inwardly directed substantially uniform velocity of air flow from outside said vestibule through said outer opening and across the full cross sectional area of said outer opening of said vestibule.

20. The method of preventing airborne sprayed material from escaping from a spray booth in which conveyed products are continuously coated with the sprayed material, which method comprises, sealing said booth against the ingress and egress of air except through entrance and exit ports of the booth through which product enters and exits the booth, creating a vestibule sealed relative to the booth around each of said entrance and exit ports of said booth, said vestibule having an outer opening, connecting an exhaust system to said vestibule for withdrawing air from the vestibule, drawing air from outside said booth through said vestibule opening into said vestibule exhaust system without simultaneously drawing any substantial quantity of air from inside said booth so as to create a relatively high velocity air flow barrier to the escape from said booth of airborne sprayed material.

21. The method of claim 20 further including the step of creating an air curtain within each of said vestibules directed inward toward said booth.

22. A coater comprising, a coating chamber adapted to have an object conveyed through it, said coating chamber having side walls, end walls, a bottom and a ceiling, entrance and exit openings in said end walls through which objects may be introduced into and out of said chamber, means for creating an area within the chamber wherein an object is coated with a sprayed material in the course of passage through the area, air flow control vestibules extending outwardly from each end of said chamber adjacent said entrance and exit openings, each of said vestibules having an outer opening longitudinally aligned with but remote from the associated entrance and exit openings of said chamber, means for exhausting air from said vestibules, and means for drawing air from outside said vestibules through said vestibules' outer opening into said vestibule exhaust means without simultaneously drawing any substantial quantity of air from inside said chamber so as to create an air flow barrier to the escape from said chamber of airborne sprayed material.

23. A coater comprising, a coating chamber adapted to have an object conveyed through it, said coating chamber having side walls, end walls, a bottom and a ceiling, entrance and exit openings in said end walls through which objects may be introduced into and out of said chamber, means for creating an area within the chamber wherein an object is coated with a sprayed material in the course of passage through the area, at least one air flow control vestibule extending outwardly from one end of said chamber adjacent one of said entrance or exit openings, said vestibule having an outer opening longitudinally aligned with but remote from said one opening of said chamber, means for exhausting air from said vestibule, and means for drawing air from outside said vestibule through said vestibules' outer opening into said vestibule exhaust means without simultaneously drawing any substantial quantity of air from inside said chamber so as to create an air flow barrier to the escape from said chamber of airborne sprayed material.

* * * * *